United States Patent [19]

Briese

[11] Patent Number: 4,884,480

[45] Date of Patent: Dec. 5, 1989

[54] ADJUSTABLE SOCKET DEVICE

[76] Inventor: Tim K. Briese, 18185 Boughs Pl., Colorado Springs, Colo. 80908

[21] Appl. No.: 69,252

[22] Filed: Jul. 2, 1987

[51] Int. Cl.[4] ..... B25B 13/18

[52] U.S. Cl. ..... 81/128; 81/165; 81/129; 81/157

[58] Field of Search ..... 81/128, 129, 155, 157, 81/165, 129.5; 279/55-58, 64-66, 69-70, 74

[56] References Cited

U.S. PATENT DOCUMENTS

| | | | |
|---|---|---|---|
| 164,658 | 6/1875 | Powers | 279/64 |
| 594,587 | 11/1897 | Almond | 279/56 |
| 1,482,075 | 1/1924 | Fisher | 81/128 |
| 2,582,444 | 1/1952 | Lucht | 81/128 |
| 2,778,260 | 1/1957 | Jovanovich | 81/DIG. 5 X |
| 3,385,142 | 5/1968 | Cunningham | 81/129.5 |
| 3,795,406 | 3/1974 | Rohm | 279/56 |
| 4,136,588 | 1/1979 | Roder | 81/165 |
| 4,213,355 | 7/1980 | Colvin | 81/128 |

FOREIGN PATENT DOCUMENTS

| | | | |
|---|---|---|---|
| 36068 | 12/1911 | Sweden | 279/56 |

*Primary Examiner*—D. S. Meislin

*Attorney, Agent, or Firm*—Timothy J. Martin; J. Preston Oxenham

[57] ABSTRACT

An adjustable socket provides continuous sizing from a minimum opening to a maximum opening to accommodate differently sized nut structures. The socket includes a socket body having a head portion and a pair of longitudinal wing portions separated by a channel region defined by a slideway region and a keyway region. A pair of jaw members are provided, each having a slide element received in the keyway region for transverse reciprocal movement and a jaw element projecting longitudinally of its slide element and received in the slideway region. When mounted, the jaw elements have facing interior work faces and oppositely facing, exterior cam surfaces. The wing portions are externally threaded and threadably receive a collar. Biasing springs apply restorative force tending to separate the jaw elements to open the region between the work faces. The collar bears against the cam surfaces and acts in constraining opposition to the biasing springs whereby constrained selective adjustment of the opening for the nut structure is obtained. The slide elements are otherwise freely slideable transversely in the keyway reigon, but they include interlock structure to prevent longitudinal movement in the socket body. An indexed area may cooperate with the collar to indicate the nut structure opening size in conventional units.

31 Claims, 4 Drawing Sheets

ADJUSTABLE SOCKET DEVICE

BACKGROUND OF THE INVENTION

The present invention is directed to a socket device which is adjustable to accommodate differently sized bolts and nuts. Therefore, the present invention is useful in mechanically driving both standard and metric sized nuts and bolts over a broad continuous range of sizes. As such, the present invention may be employed in place of a plurality of non-adjustable sockets that are normally sold as sets wherein each member of the set has a different, non-adjustable size. Furthermore, the inventive concept and implementation of the present invention finds application as a hand operated adjustable wrench.

One of the most commonly used tools for any mechanic is that tool known as a wrench and socket set. Typically, this tool assembly includes various ratchet drivers, straight bar drivers, length and swivel adapters as well as a plurality of cylindrical sockets organized as a set of differently sized members that accommodate differently sized nuts and bolts. These sets are usually sold as standard "English" sets or metric sets. While such sets are an invaluable tool for mechanics and while such sets have definite advantages in that each socket has a relatively small diametric size, these sets nonetheless have distinct disadvantages. Since each socket is non-adjustable, it is necessary for the mechanic to carry anywhere from 16 to 32 separate pieces to allow for the wide variety of nuts and bolts which are encountered during mechanical activities. Hence, where a number of differently sized nuts and bolts are employed in a particular piece of machinery or equipment, the mechanic often finds it necessary to keep interchanging these sockets on the socket driver. Otherwise, the mechanic must have several different duplicate drivers. The continual need to change sockets on a single driver can result in substantial lost time and concomitant expense. In addition, it is easy for a mechanic to misplace a socket which again leads to lost time and frustration. The need for duplicate drivers unnecessarily increases the expense of a set of tools.

Other disadvantages are also present in traditional socket sets where a person needs to store a set of tools in a compact storage location for emergency use. Examples of such needs include automobile and vehicle emergency kits which are commonly stowed in a trunk or other storage compartment of a vehicle and in the boating industry where it is desirable to carry a small but versatile tool set either on the boat or accompanying the boat trailer. In such applications, complete socket sets prove very bulky; with the decreasing size of automobiles and storage compartments associated therewith, the practicality of sets as part of an emergency tool kit becomes less certain. As a result of these disadvantages, there has been a longfelt need for an adjustable socket which may be used with traditional socket drivers yet which allows a fairly wide range of adjustable size and which may thus accommodate both standard and metric sized nuts and bolts.

Prior to the present invention, others have sought to satisfy this need and have approached the problem of constructing an adjustable socket in a manner different from that of the present invention. For example, U.S. Pat. No. 3,385,142 issued May 28, 1968 to Cunningham shows an adjustable socket wherein a pair of jaw elements are attached to slide racks which are provided with gear teeth. The socket body includes a transverse opening provided with an axially oriented gear so that one slide rack may be inserted in either side of the gear which may be turned by an adjusting wheel to move the jaw elements together and apart. Thus, the jaw members are freely suspended, and are only supported by the interraction of the slide rack and drive gear. Similarly, U.S. Pat. No. 4,136,588 issued Jan. 30, 1979 to Roder shows an adjustable socket wherein a pair of jaw elements are suspended by slide racks which are inserted into an opening in the socket body and are driven by helical gears to move toward and away from one another. On each of these two patents, the jaw elements are only minimally supported and can be subject to damage resulting from the substantial torques encountered when the socket drives a nut structure.

Other prior art patents are directed to adjustable sockets in the form of chuck assemblies wherein a plurality of small jaws are movable on inclined surfaces toward and away from one another over a small degree of adjustment. Examples of such chuck assemblies are shown in U.S. Pat. No. 164,658 issued Jun. 22, 1875 to Powers, U.S. Pat. No. 2,582,444 issued Jan. 15, 1952 to Lucht and U.S. Pat. No. 4,213,355 issued Jul. 22, 1980 to Colvin.

While the above-cited patents describe adjustable socket or socket-type structures, these apparatus have apparently not received wide spread use. Accordingly, there remains a need for an inexpensive adjustable socket that is constructed of a relative few number of parts so that it is easy to manufacture and assemble. There is a further need for such an adjustable socket which has enhanced mechanical strength and which is adjustable over a wide range of nut structure sizes. The present invention is directed to meeting these needs.

SUMMARY OF THE INVENTION

It is an object of the present invention to provide a new and useful adjustable socket that is simple in manufacture and easy in assembly.

Another object of the present invention is to provide a relatively inexpensive adjustable socket that is adjustable over a wide range of nut structure sizes to accommodate a variety of nuts, bolts and the like.

It is a further object of the present invention to provide an adjustable socket which is continuously adjustable so as to accommodate both English and metric sized nut structures.

A still further object of the present invention is to provide an adjustable socket which has increased mechanical strength and wherein the adjustment member increases the mechanical strength of the socket when the socket is used on increasingly larger sized nut structures.

A still further object is to provide a compact, strong, adjustable socket which can be stored in minimal space.

Accordingly, the present invention is directed to an adjustable socket which is operative to rotatably drive a nut structure and which is adapted to be selectively adjustable in order to accommodate different sizes of nut structures. The adjustable socket broadly includes a socket body having a longitudinal axis and comprises a head portion and a pair of wing portions which are rigidly secured to the head portion and extend longitudinally in spaced-apart relation to one another from a first side of the head portion on either side of the longitudinal axis. The wing portions are separated by a transverse channel region which extends diametrically through the socket body, and the wing portions have first and second flat interior surfaces facing each other in opposed relation to define a slideway region therebetween. First and second jaw members are slideably received in the channel region for transverse reciprocal movement in the socket body. Each of these jaw members include a slide element oriented transversely of the channel region and a jaw member secured to the slide member and oriented longitudinally of the socket body. Each jaw element is configured to extend between and be slideably supported by the flat inner surfaces of the slideway. Each jaw element has a longitudinal outer surface which faces laterally outwardly of the channel region and a longitudinal inner surface which faces inwardly into said channel region and defines a work face adapted to engage the nut structure. Thus, a pair of work faces are provided which are oriented in opposed facing relation to one another and which are movable toward and away from one another as the first and second jaw members are reciprocally moved in the socket body. A biasing means, preferably in the form of a spring, biases each of the jaw members apart from one another so as to increase the distance between the work surfaces. A constraining means, preferably in the form of a collar, mechanically acts on each jaw element in opposition to the biasing means in order to prevent expansion of the space between the work surfaces with the constraining means being selectively operable to vary the maximum degree of expansion between the work surfaces.

In the preferred form of the present invention, the longitudinal outer surfaces of each jaw element are preferably formed as cam surfaces oriented at a cam angle of 65° to 85° along the surface of the geometric cone with the cam surfaces having a greater dimension at a location adjacent the head portion and then tapering in a convergent manner in a direction toward the free ends of the wing portions. The wing portions have outer arcuate surfaces oriented on the surface of a geometric cylinder and are threaded so that the collar may be threadably received on the wing portions so that the collar bears against the cam surfaces. Thus, as the collar is advanced along the wing portions, the collar drives the cam surfaces to force the jaw elements toward one another or to allow them to expand away from one another, depending upon the direction of longitudinal movement of the collar. One of the arcuate surfaces may be provided with index markings with which the collar registers to indicate the adjusted size of the socket corresponding to the nut structure size. The collar is provided with a flared surface that bears against the cam surfaces and prevents the cam surfaces from contacting the threaded portion of the collar.

In the preferred form of the present invention, the slide elements of each jaw member include an innerlock structure so that the slide elements are locked against longitudinal movement within the channel region. This innerlock structure is preferably in the form of a keyway defined by an inverted T-shaped channel region adjacent the head portion of the socket body so that this lower channel region has a pair of opposed grooves that are engaged by tongues on each slide element. The slide elements may include side surfaces that abut one another to positively and mutually support one another within the channel region or, in an alternate embodiment, may abut an upstanding web extending upwardly from a bottom wall of the channel region. A pair of interior shoulders may extend transversely of the socket body to configure said channel region into the keyway and into the slideway region, and each of the jaw elements may be provided with opposite edge portions each being supported by respective interior shoulders on the wing portions. The edges of these jaw elements may be provided with cavities operative to receive the biasing spring so that a spring is located on either side of the channel region and each spring operates to bias the pair of jaw members apart. Alternately, a pair of spring cavities may be formed in the slide elements to create an enclosed spring chamber which receives a single, helical compression spring. The socket body may be manually driven or driven by a drive member. An engagement structure for the drive member is therefore provided on the head portion. This engagement structure can either be a shaft port that is preferably square-shaped in cross-section and may be a post configured to receive an open end wrench, a close-end wrench, an adjustable wrench, or the like.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention is directed to an adjustable socket which is operative to rotatably drive a nut structure and is adapted to be selectively adjusted to accommodate different sizes of nut structures. Thus, the present invention may be used to drive bolt heads, nuts, hexagonal headed screws and the like, all of which fasteners are deemed encompassed by the term "nut structures". The socket according to the preferred embodiment of the present invention is constructed to be adjustable over a continuous range of sizes in order to accommodate both "English" or standard nut sizes as well as metric nut sizes. Further, the present invention is constructed out of a minimum number of parts to reduce costs of manufacture and assembly, yet is constructed to maximize the mechanical strength of the adjustable socket. As best seen in FIGS. 1–7, the adjustable socket according to the preferred embodiment of the present invention comprises six parts, including: a socket body, a pair of identically configured jaw members, a pair of bias springs and a compression collar.

Figure 1:
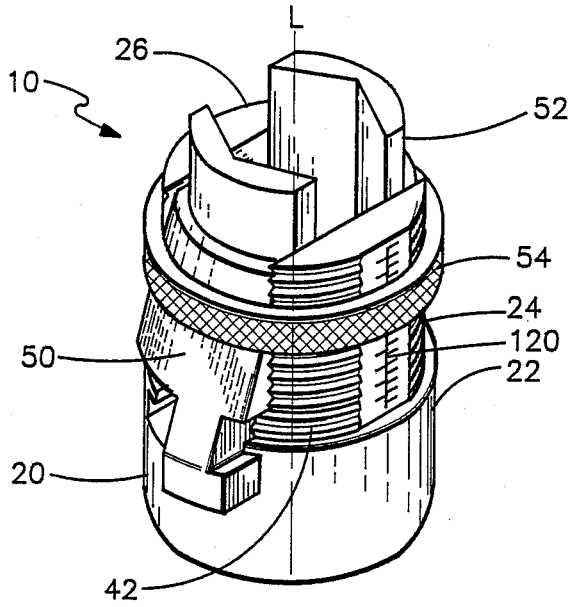
FIG. 1 is a perspective view of the adjustable socket according to the preferred embodiment of the present invention.
Figure 2:
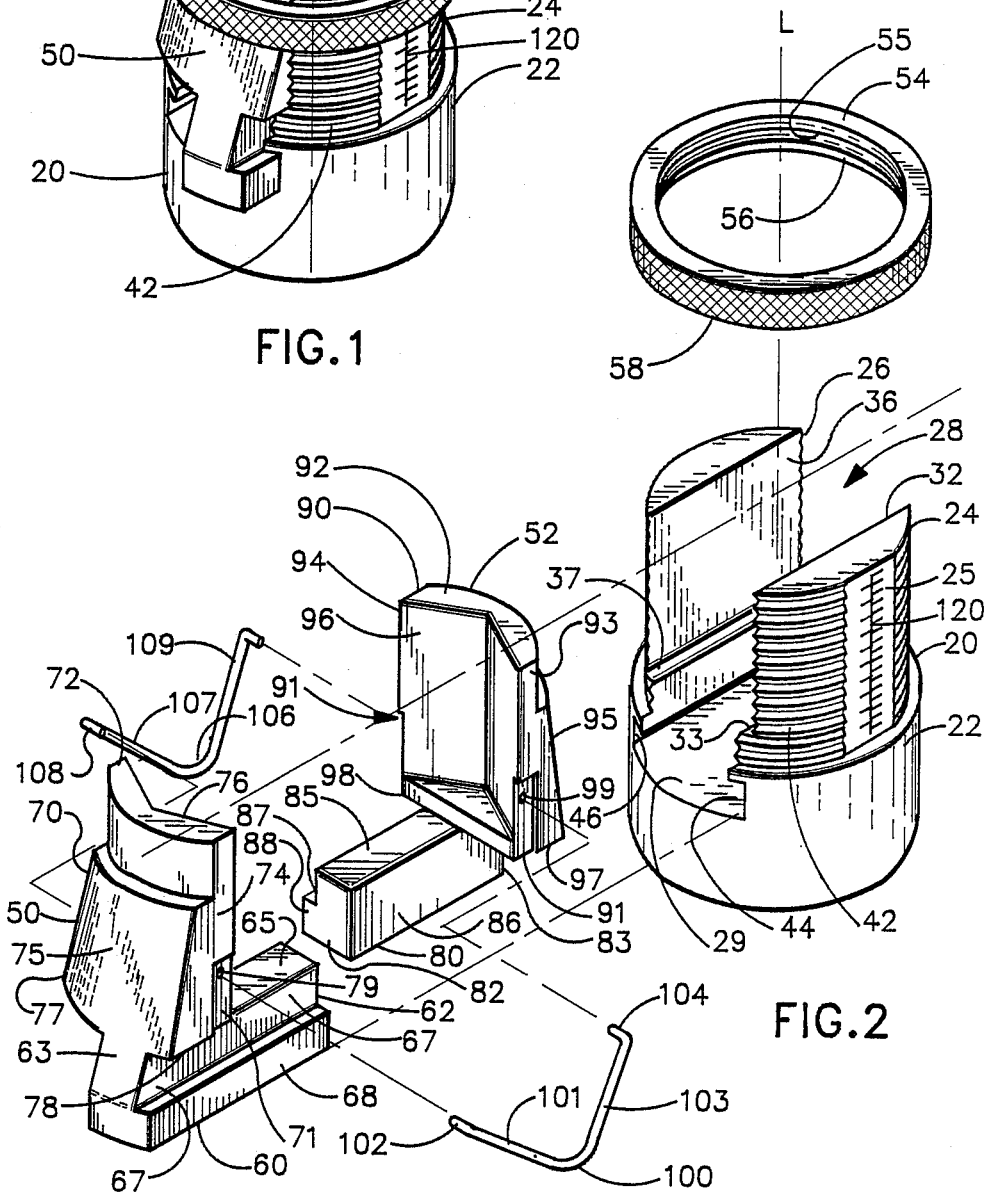
FIG. 2 is an exploded view in perspective showing the adjustable socket of FIG. 1.
Figure 3:
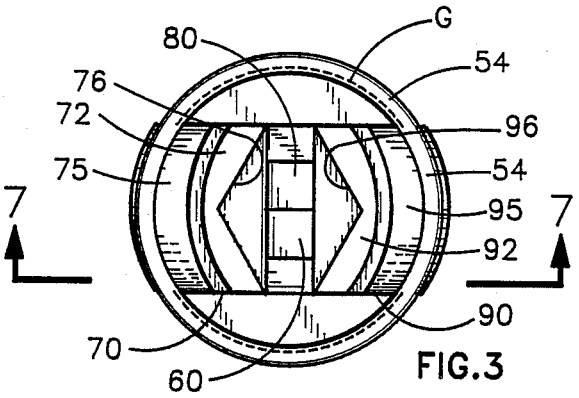
FIG. 3 is a top plan view of the adjustable socket shown in FIG. 1.
Figure 4:
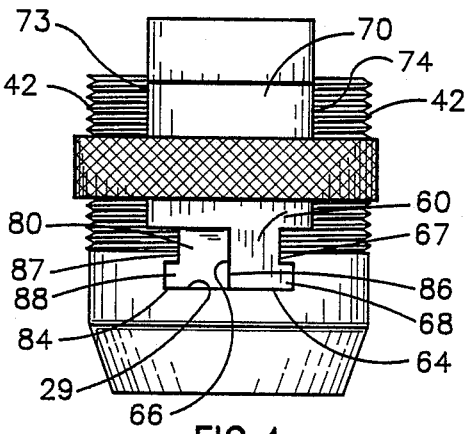
FIG. 4 is an end view in elevation of the adjustable socket shown in FIGS. 1 and 3.
Figure 5:
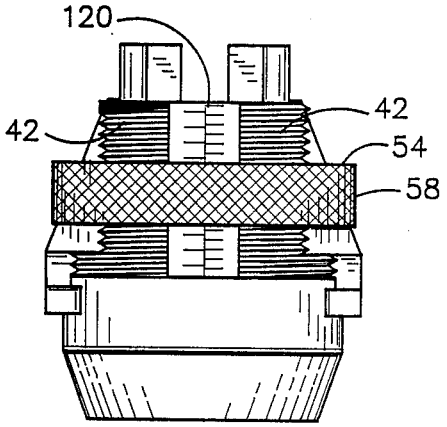
FIG. 5 is a side view in elevation of the adjustable socket shown in FIGS. 1, 3 and 4.
Figure 6:
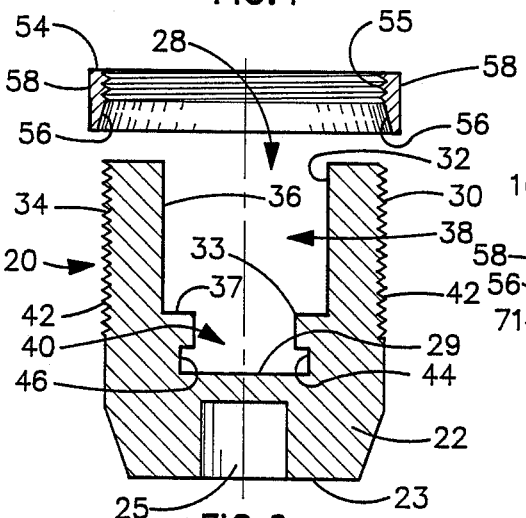
FIG. 6 is an end view in cross-section of the socket body and collar according to the present invention.

More particularly, adjustable socket 10 is shown in FIGS. 1–7 and includes a socket body 20 that includes a head portion 22, a first wing portion 24 and a second wing portion 26 rigidly secured thereto and preferably formed integrally with head portion 22 as a common unit of cast tool steel. Socket body 20 has a longitudinal axis L, and wing portions 24 and 26 extend longitudinally froma first side of head portion 22 and are oriented on opposite sides of axis L. Wing portions 24 and 26 are separated from one another by a channel region 28 that extends diametrically through socket body 20 and which has a bottom wall 29. First wing portion 24 has an exterior arcuate surface 30 and an interior flat surface 32 with flat surface 32 being best shown in FIG. 6. Similarly, second wing portion 26 has an exterior arcuate surface 34 and an interior flat surface 36. With these surfaces also being shown in FIG. 6. Flat surfaces 32 and 36 are formed substantially parallel to one another in opposed facing relation on either side of axis L and define a slideway region 38 therebetween. A lower portion of channel region 28, adjacent head portion 22, defines a keyway region 40 which is formed to have an inverted, T-shaped cross-section, as is shown in FIG. 6. Slideway region 38 and keyway region 40 are defined by means of a pair of shoulders 33 and 37 which extend transversely of the socket body respectively adjacent faces 32 and 36 of wing portions 30 and 34. Arcuate surfaces 30 and 34 are oriented in a common geometric cylinder G, as is shown in FIG. 3.

Figure 7:
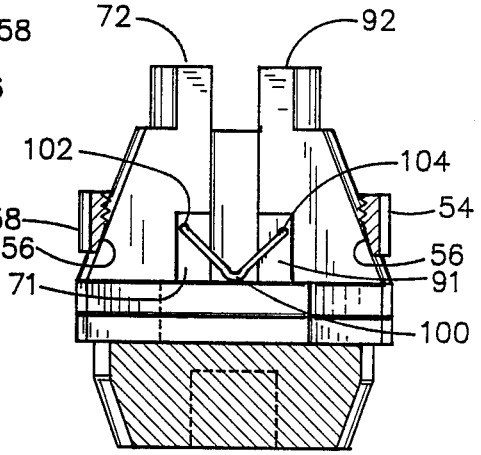
FIG. 7 is a cross-sectional view taken about lines 7—7 of FIG. 3.

Channel region 28 slideably receives a pair of jaw members 50 and 52 which are preferably constructed identically, each as an integral unit of tool steel. Jaw members 50 and 52 are best shown in FIGS. 2, 4 and 7. For example, jaw member 50 includes a slide element 60 and a jaw element 70 which are oriented at substantially right angles with respect to one another. Slide element 60 includes end faces 62 and 63, bottom face 64, top face 65 and side faces 66 and 67. An elongated tongue 68 extends along side face 67 and interlocks with a groove 44 in keyway 40, as described more thoroughly below. Jaw element 70 extends upwardly from slide element 60 and includes a flat, free end 72 and a pair of side faces 73 and 74. Jaw element 70 also has an outer surface 75 and an inner surface or work face 76. Outer surface 75 defines a cam surface for selective adjustment of socket 10, as discussed below.

Likewise, jaw member 52 includes a slide element 80 and a jaw element 90 oriented at right angles with respect to one another. Slide element 80 includes a pair of end faces 82 and 83, a bottom face 84, a top face 85 and a pair of side faces 86 and 87. An elongated tongue 88 extends along side face 87 of slide element 80 and interlocks with a groove 46 of keyway 40 as described below. Jaw element 90 extends upwardly from slide element 80 and includes a free end 92 of jaw element 90 and a pair of side faces 93 and 94. Jaw element 90 is provided with an outer surface 95 which defines a cam surface more thoroughly described below. An inner or work face 96 is located on a side of jaw element 90 opposite outer surface 95.

As is shown in FIGS. 1–7, each of jaw members 50 and 52 are configured to be slideably received in open region 28. To this end, slide elements 60 and 80 are sized and configured to fit within keyway 40 which is provided with a pair of oppositely disposed grooves 44 and 46 which respectively receive tongues 68 and 88 to provide an interlocking structure to prevent longitudinal movement of slide elements 60 and 80. Accordingly, side faces 66 and 86 are in close-fitting, abutted relationship and reciprocally slide with respect to one another in socket body 20. To this end, also, jaw element 70 is provided with a pair of side edges 77 and 78 which respectively engage shoulders 37 and 33 with jaw element 70 extending between and slideably supported on its end faces 73 and 74 by the flat inner surfaces 36 and 32, respectively. Likewise, jaw element 90 includes side edges 97 and 98 which are respectively supported at shoulders 33 and 37, respectively, so that jaw member 52 extends between flat surfaces 32 and 36 with end faces 93 and 94 respectively abutting faces 32 and 36 in sliding contact therewith. In this manner, work faces 76 and 96, which are adapted to engage a selected nut structure, are oriented in opposed facing relation to one another and are moveable toward and away from one another as jaw members 50 and 52 are reciprocally moved in socket body 20.

A pair of biasing springs 100 and 106 are provided to respectively bias jaw members 50 and 52 in a laterally outward direction in order to expand the space between work faces 76 and 96. Each bias spring 100 and 106 are formed as V-shaped springs which extend between jaw members 50 and 52. Bias spring 100 includes a first leg 101 that terminates in an inwardly projecting foot 102 and a second leg 103 which terminates in an inwardly projecting foot 104. Similarly, bias spring 106 has a first leg 107 that terminates in an inwardly turned foot 108 and a second leg 109 that terminates in an inwardly projecting foot 110. In order to facilitate mounting of springs 100 and 106, each of side faces 73, 74 and 93, 94 are provided with cavities in the form of rectangular regions. As is shown in FIGS. 2 and 7, for example, jaw member 50 has a pair of cavities such as cavity 71 while jaw member 52 is provided with a pair of cavities 91. Each of cavities 71 is provided with a bore 79 operative to receive feet 102 and 108 of springs 100 and 106, respectively, while cavities 91 are provided with bores 99 operative to receive feet 104 and 110 of springs 100 and 106, respectively. Cavities 71 and 91 separate their respective sidewalls into first and second sidewall portions as is shown best in FIG. 2.

In order to prevent jaw members 50, 52 and slide elements 60, 80 from moving laterally outwardly to become disengaged from channel region 28, a constraining means mechanically acts on each jaw element in opposition to the biasing springs. This constraining means is also operative to prevent expansion of the space between the work surfaces and to increase mechanical strength of adjustable socket 10. As is shown in FIGS. 1–7, this constraining means is preferably in the form of collar 54 which is annular shape and which is provided with an inner threaded surface 55 to engage threads 42 on first and second wing portions 24 and 26. Thus, collar 54 is threadably received on socket body 20 and may be threaded for longitudinal movement with respect to head portion 22. As is best shown in FIGS. 6 and 7, collar 54 includes an inner flared surface 56 that bears against outer cam surfaces 75 and 95 and is in slideable abutting relation to surfaces 75 and 95. Inner flared surface 56 prevents contact between cam surfaces 75 and 95 with the inner threaded surfaces 55 of collar 54 in order to avoid scoring or other damage to the cam surfaces. Collar 54 has an outer perimeter surface 58 which is knurled to facilitate manual gripping and rotation of collar 54 on socket body 20.

The assembly and operation of adjustable socket 10 can now be appreciated with more particularity with reference to FIG. 2. In assembly, jaw members 50 and 52 are first oriented with respect to one another so that work faces 76 and 96 are in opposed relation so that slide elements 60 and 80 may be placed in abutting relationship with slide surfaces 66 and 86 in abutting relation. To this end, and as is seen in FIG. 2, each slide element 60 and 80 are offset slightly from the longitudinal central axis of their respective jaw elements 70 and 90. Once jaw members 50 and 52 have been properly positioned, the assembler places each spring 100 and 106 into position by placing feet 102 and 108 in bores 79 and feet 104 and 110 into bores 99. The main body of each spring 100 and 106 is then located in respective cavities 71 and 91 between the respective side edges of jaw elements 70 and 90 and shoulders 33 and 37. This subassembly is then inserted into channel region 28 which confines springs 100 and 106 so that they may not be removed. Jaw elements 70 and 90 extend longitudinally past the free ends of wing portions 24 and 26 to terminate in free ends 72 and 92, respectively, in longitudinally spaced relation to the ends of wing portions 24 and 26. Jaw members 50 and 52 are then moved laterally with respect to one another to decrease the space between work faces 76 and 96, and annular collar 54 is placed over free ends 72 and 92 to be threadably received on wing portions 24 and 26. Once collar 54 is mounted on socket body 20, the assembler releases jaw members 50 and 52 so that jaw elements 70 and 90 as well as slide elements 60 and 80 move laterally outwardly of the respective slideway 38 and keyway 40 until cam surfaces 75 and 95 contact inner flared surface 56 of collar 54. An uppermost thread may be deformed, such as at 43 shown in FIG. 5, to prevent inadvertent removal of collar 54 once assembly has been completed. This deformed region 43 thus provides a limit stop for adjustment in the maximum opened position and prevents removal of collar 54.

Figure 8:
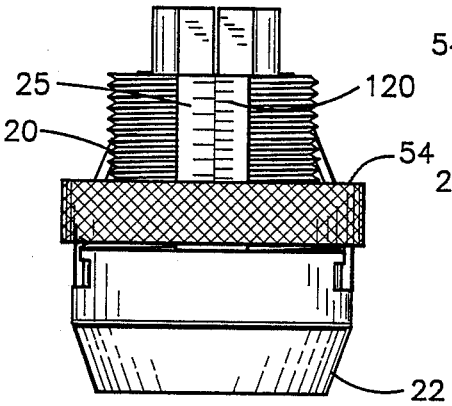
FIG. 8 is a side view in elevation of the adjustable socket according to the present invention in a maximum opened position.
Figure 9:
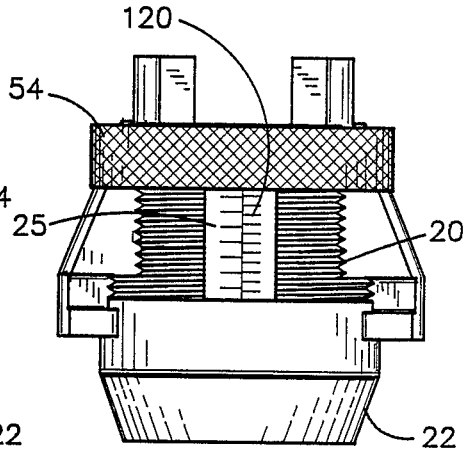
FIG. 9 is a side view in elevation of the adjustable socket according to the present invention in a minimum opened position.

In operation, as is best shown in FIGS. 5, 8 and 9 the user simply threadably rotates collar 54 in the desired direction to increase or decrease the distance between work faces 76 and 96 so as to obtain proper sizing for the nut structure to be engaged. If the user wants to decrease this distance for a smallest nut structure, collar 54 is rotated clockwise until it is adjacent head portion 22 as is shown in FIG. 8. It should be appreciated from a view of the Figures that cam surfaces 75 and 95 are located on a geometric cone so that downward longitudinal movement of collar 54 toward head portion 22 causes flared surface 56 to operate against cam surfaces 75 and 95 to force work faces 76 and 96 together against the biasing force of springs 100 and 106. The cam angle is preferably selected to be between 65° and 85°, inclusive, measured with respect to a transverse axis that is perpendicular to the longitudinal axis L. Should a larger nut structure be desired to be engaged, the user rotates collar 54 in a counter-clockwise direction to move it away from head portion 22 and toward the free ends of wing portions 24 and 26. This allows jaw members 50 and 52 to be laterally moved under the influence of biasing springs 100 and 106 so as to increase the distance between work faces 76 and 96. Thus, FIG. 5 shows an intermediate position, and FIG. 9 shows a maximum opened position.

It should be appreciated from this arrangement that, when a larger nut structure is to be engaged, which situation normally results in greater torque forces, collar 54 is moved closer to free ends 72 and 92 of jaw elements 70 and 90 as is shown in FIG. 9. Thus, when greater forces are encountered, collar 54 aids in constraining deflection of jaw elements 70 and 90 to enhance the mechanical strength of the adjustable socket. Further, by providing a large annular ring 54, the user is able to easily grip the collar for manual adjustment of the socket for varying nut structure sizes. Furthermore, one of wing portions 24, 26 may be formed with a flattened area, such as area 120 on wing portion 24, and this flattened area may be suitably indexed to correspond to nut structure size. As is shown in FIGS. 1, 2 5, 8 and 9, area 25 includes index markings 120 such that registration of collar 54 with markings 120 indicate the nut structure size for engagement by adjusted work faces 76, 96. Markings 120 may be in standard units, metric units or both since the structure of adjustable socket 10 permits infinite continuous adjustment between the minimum opening of FIG. 8 and the maximum opening of FIG. 9.

It should be appreciated that, if desired, adjustable socket 10 may be manually rotated without use of any wrench or other drive member. However, in the preferred form of the present invention a second side of head portion 22 opposite wing portions 24 and 26 is provided with an engagement means adapted to engage such a drive member. As is shown best in FIG. 6, surface 23 is provided with a square-shaped opening or shaft port 25 that is sized to engage the conventional drive shaft of a socket wrench and the like.

Figure 10:
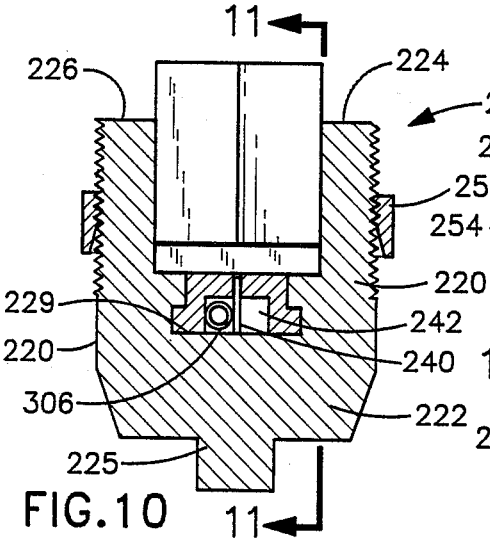
FIG. 10 is a cross-sectional view of a first alternate embodiment of the present invention.
Figure 11:
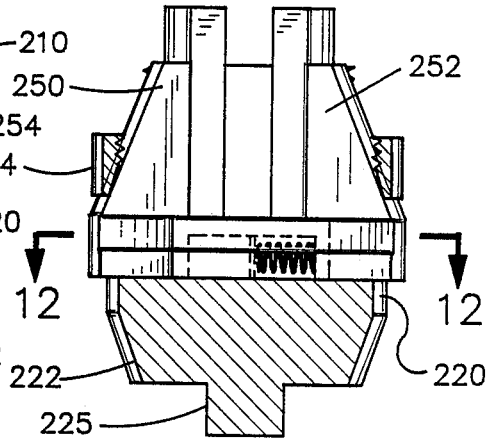
FIG. 11 is a plan view taken about lines 11—11 of FIG. 10.
Figure 12:
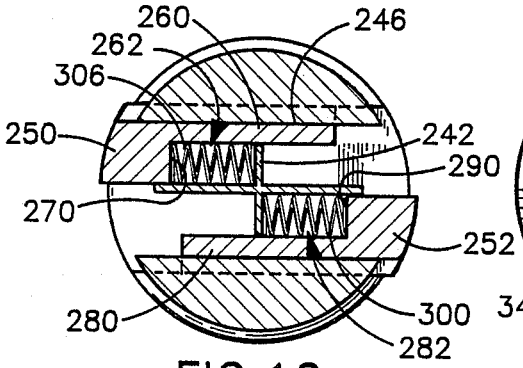
FIG. 12 is a cross-sectional view taken about lines 12—12 of FIG. 11.

An alternate embodiment of the present invention is shown in FIGS. 10–12. In the alternate embodiment, two modifications are made to the basic structure shown in FIGS. 1–9 and described with respect to the preferred embodiment. Specifically, these modifications are directed to the biasing means which bias the jaw members outwardly from one another and laterally to the adjustable socket. A second modification is made to the engagement means for engaging a drive member such as a wrench or other leverage device.

As is shown in FIGS. 10–12, then, an adjustable socket 210 includes a socket body 220, a pair of jaw members 250 and 252, a collar 254 and a pair of biasing springs 300 and 306. Socket body 220 is similar to socket body 20 in that it has a pair of upstanding, longitudinal wing portions 224 and 226 which project from one side of a head portion 222. Jaw members 250 and 252 are received in a channel opening located between wing portions 224 and 226 as described with respect to the preferred embodiment. However, in the alternate embodiment of the present invention, an upstanding rigid first web 240 extends upwardly from bottom wall 229 of the channel region and a second web 242 extends upwardly from bottom wall 229 and is perpendicular to web 240. Web 240 separates the lower portion of the channel opening into a pair of keyways 246 and 248.

Figure 13:
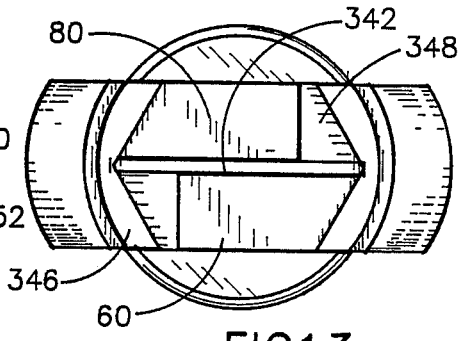
FIG. 13 is a cross-sectional view showing a second alternate embodiment of the present invention.

Jaw member 250 includes a slide element 260 that is modified by providing a channel 262. Similarly, jaw member 252 includes a slide element 280 which is modified by providing a channel 282 therein. Each of slide elements 260 and 280 are received for reciprocal movement in a respective keyway 246 and 248. It should be appreciated from a review of FIGS. 10 and 12 that each of channels 262 and 282 are sized so as to accommodate the dimension of web 242 with each of slide elements 260 and 280 being sized so that they slide along and are supported by web 240. Biasing means in the form of a pair of bias springs 300 and 306 are then provided and, as is shown in FIG. 12, helical spring 306 is positioned in channel 262 so that it expands against web 242 and wall 270 of jaw member 250. Similarly, bias spring 300 is a helical spring that bears against an opposite side of web 242 and wall 290 of jaw member 252. This modified structure then provides a different biasing means that is totally contained within the socket structure and is not exposed to grit and dirt from the environment. It should be appreciated, also, that web 242 could be eliminated with web 240 remaining in place and that the biasing structure and jaw structure of the preferred embodiment be used with web 240. In such case, each slide element 60 and 80 would slide against a web such as web 342, rather than against each other in a pair of keyways 346 and 348. This structure is depicted in the alternate embodiment shown in FIG. 13.

As is also shown in FIGS. 10–12, socket 210 is constructed to be driven by a standard wrench which can either be a boxed-end wrench, a closed-end wrench, a standard adjustable wrench and the like. To accomplish this, head portion 222 is provided on a side opposite wing portions 224 and 226 with an upstanding post 225 which is preferably configured hexagonally in shape so as to accommodate a standard sized box-end wrench, openend wrench, crecent wrench and the like; post 225 could also be configured in any other suitable shape for other drive tools known in the art. Preferably, post 225 is formed integrally with head portion 222 as an integral piece of tool steel. It should be understood, however, that the drive shaft port as described with respect to the preferred embodiment could be used with this alternate embodiment as well. The use and operation of the alternate embodiment shown in FIGS. 10–12, then, is the same as that described with respect to the preferred embodiment.

Figure 14:
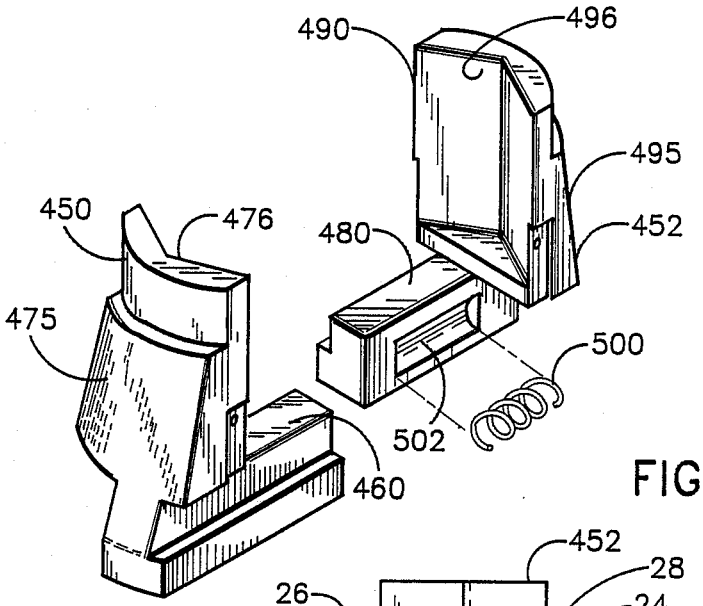
FIG. 14 is an exploded perspective view of a third alternate embodiment of the jaw members and biasing spring structure according to the present invention.
Figure 15:
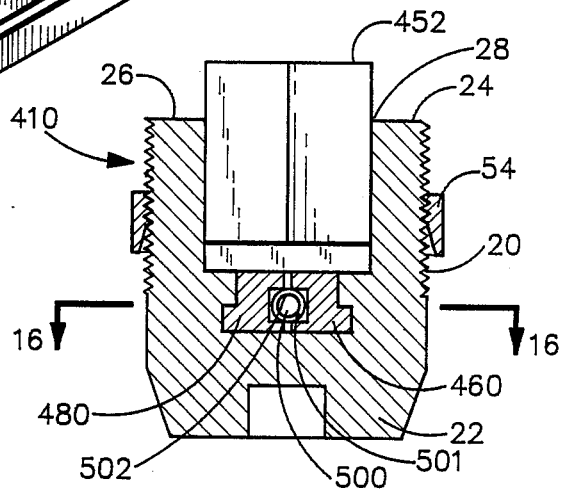
FIG. 15 is a side view in cross-section of the present invention employing the jaw members and biasing spring of FIG. 14.
Figure 16:
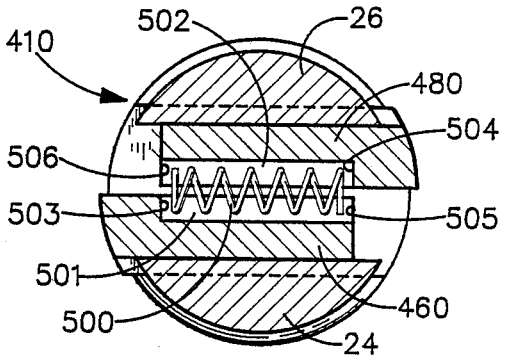
FIG. 16 is a cross-sectional view taken about lines 16—16 of FIG. 15.

A third embodiment of the present invention is shown in FIGS. 14–16, and this third embodiment modifies the jaw members and structure which structure is used with the socket body and collar shown in the preferred embodiment of FIGS. 1–9. As is shown in FIGS. 14–16, then, a pair of jaw members 450 and 452 are mountable within channel 28 of socket body 20 between first and second wing portions 24 and 26. Jaw member 450 includes a slide element 460 and a jaw element 470 which extends upwardly from slide element 60 and includes an outer cam surface 475 and an inner work face 476. Similarly, jaw member 452 includes a slide element 480 and a jaw element 490 having an outer cam surface 495 and an inner work face 496. Jaw members 450 and 452 are constructed almost identically with jaw members 50 and 52 but cavities 71 and 91 are eliminated.

As is shown in FIGS. 14–16, slide element 460 is provided with a spring cavity 501 and slide element 480 is provided with a matching spring cavity 502. Thus, when slide elements 460 and 480 are placed in abutting, sliding relation, spring cavities 501 and 502 face one another and form a spring chamber that receives a helical or coil spring 500. Preferably, each of spring cavities 501 and 502 are half-cylindrical in shape so that, when they are placed together, the spring chamber is a cylindrical chamber which receives spring 500. As is best shown in FIG. 16, spring cavity 501 has a pair of end faces 503 and 505 while spring cavity 502 has a pair of end faces 504 and 506. In FIG. 16, the socket assembly 410 is shown in its most open position. Collar 54 is threadably received on wing portions 24 and 26 and advances downwardly against cam surfaces 475 and 495. As this happens, end face 503 of cavity 501 moves toward end face 504 of cavity 502, thus compressing spring 500 therebetween. Similarly, when collar 54 is moved longitudinally away from head portion 22 of socket body 20, spring 500 forces endwalls 503 and 504 apart thereby expanding the opening between work faces 476 and 496. It may accordingly be appreciated from a review of FIGS. 15 and 16, then, that spring 500 is completely enclosed within the spring chamber formed by cavities 501 and 502 in slide elements 460 and 480, respectively, and spring 500 is thus in a protected environment.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. An adjustable socket operative to rotatably drive a nut structure and adapted to be selectively adjustable to accommodate different sizes of nut structures, comprising:

a socket body including a head portion and first and second wing portions longitudinally projecting from a first side of said head portion on opposite sides of a longitudinal axis through said socket body and having threaded exterior surfaces formed on a common cylinder about said axis, said first and second wing portions separated from one another by a channel region extending diametrically through said socket body and respectively provided with first and second interior surfaces facing each other in opposed relation to define a slideway region therebetween;

first and second jaw members slideably mounted in said channel region for transverse reciprocal movement in said socket body, each jaw member including a slide element slideably received in said channel region and a jaw element rigidly supported by a respective slide element and projecting longitudinally of said socket body, each jaw element configured with a width defined by opposite longitudinal sidewall portions to extend between and be slideably supported by said sidewall portions which respectively abut said interior surfaces, each jaw element having a longitudinal outer surface facing laterally outwardly of said channel region and formed as a cam surface oriented at a cam angle with respect to a transverse axis perpendicular to the longitudinal axis, and a longitudinal inner surface defining a work face adapted to engage said nut structure, said work faces oriented in opposed facing relation to one another and away from one another as said first and second jaw members are reciprocally moved in said socket body;

biasing means for biasing said jaw members apart from one another to expand the space between said work surfaces; and constraining means including a collar threadably received on said wing portions and movable longitudinally of said socket body to engage said cam surfaces to selectively vary the maximum degree of expansion between the work surfaces.

2. An adjustable socket according to claim 1 wherein said collar has an inner flared surface which contacts said cam surfaces to prevent said cam surfaces from contacting said inner threaded surface.

3. An adjustable socket according to claim 1 including limit stop means for preventing removal of said collar from said socket body.

4. An adjustable socket according to claim 1 including index markings correlated to the size of the opening between said work faces whereby said markings indicate the selected nut structure size for engagement thereby.

5. An adjustable socket according to claim 4 wherein said index markings are provided on one of said first and second wing portions, said collar operative to register with said index markings to indicate the selected nut structure size.

6. An adjustable socket according to claim 1 wherein said cam angle is between 65° and 85°, inclusive.

7. An adjustable socket according to claim 1 wherein said bottom surface slideably supports a bottom face of each slide element, each slide element includes a tongue structure adjacent said bottom face, and said channel region includes a groove structure operative to cooperate with said tongue structures to prevent longitudinal movement of said slide elements while permitting free transverse movement.

8. An adjustable socket according to claim 7 wherein said slide elements have first side faces which slideably abut and support one another in said channel region.

9. An adjustable socket according to claim 7 including an upstanding web extending transversely along said bottom surface to define a pair of keyways, each said keyway operative to receive a respective slide element for reciprocal movement therein.

10. An adjustable socket according to claim 9 wherein each of said first and second wing portions have an interior shoulder extending transversely of said socket body to define said channel region and said slideway region, said keyway region located adjacent said head portion and operative to receive said slide elements, each of said jaw elements having opposite edge portions each supported by a respective interior shoulder.

11. An adjustable socket according to claim 1 wherein each jaw element has opposite second sidewall portions recessed with respect to said first sidewall portions whereby four cavities are formed as a first pair of cavities between the first interior surface and a second sidewall portion of each of the first and second jaw elements and a second pair of cavities between the second interior surface and an opposite second sidewall portion of each of the first and second jaw elements, said biasing means including a first V-shaped spring associated with said first cavity pair and a second V-shaped spring associated with said second cavity pair, each said spring having one leg extending into each cavity of its respective cavity pair.

12. An adjustable socket according to claim 11 wherein each second sidewall portion has a bore formed therein, each leg of said V-shaped spring terminating in a foot portion received in a respective said bore.

13. An adjustable socket according to claim 1 wherein each said jaw element terminates in a free end longitudinally spaced from said wing portions opposite of said head portion.

14. An adjustable socket according to claim 1 wherein said head portion is adapted to be rotatably driven by a drive member having a drive head, said head portion provided with engagement means for engaging the drive head, said engagement means located on a second side of said head portion opposite said wing portions.

15. An adjustable socket according to claim 14 wherein said engagement means includes a drive shaft port.

16. An adjustable socket according to claim 14 wherein said engagement means includes an upstanding longitudinal post.

17. An adjustable socket according to claim 1 wherein each of said slide elements has a longitudinal spring cavity formed therein, said spring cavities facing one another to form a spring chamber when said jaw members are mounted in said channel, said biasing means including a spring member positioned in said spring chamber whereby movement of said work faces toward one another operates to compress said spring member.

18. An adjustable socket according to claim 1 in which said channel region has a bottom surface, each of said slide elements has a bottom face, and each bottom face slideably engages said bottom wall.

19. An adjustable socket as in claim 17 in which said key way region includes a bottom surface and each elongated slide element has a bottom face, and each bottom face slideably engages said bottom surface.

20. An adjustable socket adapted to be rotatably driven by a drive member to correspondingly drive a nut structure, the adjustable socket being adjustable to accommodate different sizes of nut structures, comprising:

a socket body having a longitudinal axis and including a head portion and first and second wing portions formed integrally therewith and projecting longitudinally from a first side of the head portion on either side of said longitudinal axis to terminate in free wing ends, said head portion having an engagement structure on a second side opposite said wing portions and operative to engage a drive member, said wing portions having exterior arcuate surfaces oriented in a common cylindrical surface and provided with threads, said first and second wing portions separated from one another by a channel region extending diametrically through said socket body such that said first and second wing portions respectively have first and second flat interior surfaces in opposed relation to one another, said channel region defining a keyway region adjacent the head portion and slideway region between the opposed flat interior surfaces;

first and second jaw members freely mounted in said channel region for transverse reciprocal sliding movement therein, each said jaw member including an elongated slide element positioned transversely of said socket body and located in said keyway and a jaw element rigidly attached to said slide element and positioned longitudinally of said socket body, each jaw element configured to have a width extending between said first and second flat interior surfaces, said jaw elements each having an outer cam surface formed as a portion of a geometric cone and each jaw element having an inner work face adapted to engage said nut structure, said jaw elements mounted in said slideway whereby said work surfaces are in opposed facing relation and being reciprocally slideable in a transverse direction whereby said work surfaces move toward and away from one another to accommodate differently sized nut structures;

bias means for biasing said jaw members radially outwardly of said socket body; and an annular collar member inwardly threaded and threadably received on said first and second wing portions and having an inner contact surface bearing against said cam surfaces to define a selectively adjustable maximum distance of separation between said work surfaces and whereby threaded advancement of said collar in a first longitudinal direction acts on said cam surfaces to force said working surfaces together against the force of said biasing means and whereby advancement of said collar in an opposite second longitudinal direction allows said biasing means to expand the space between said working surfaces.

21. An adjustable socket according to claim 20 wherein said keyway has interlock means associated with each slide element for preventing longitudinal movement of said slide elements.

22. An adjustable socket according to claim 21 wherein said interlock means is a tongue and groove structure having a pair of grooves formed outwardly of said keyway so that the keyway has an inverted T-shaped cross-section, each slide element having a tongue slideably received in and engaged by a respective groove.

23. An adjustable socket according to claim 20 including a shoulder on each of said first and second wing portions in said channel region to define said slideway and keyway regions, each of said jaw elements having a pair of edge portions supported by a respective shoulder.

24. An adjustable socket according to claim 20 wherein said slide elements have abutting side faces which slideably support one another within said keyway.

25. An adjustable socket according to claim 20 including an upstanding web rigidly secured to said head portion and extending transversely thereto along the keyway to separate the keyway into a first keyway region receiving one of said slide elements and a second keyway region receiving the other of said slide elements whereby each slide element is positively supported for sliding movement against said web.

26. An adjustable socket according to claim 20 wherein said cam surfaces taper toward one another in a longitudinal direction away from said head portion such that said work surfaces are farthest apart when said collar is adjacent said free wing ends whereby said collar helps prevent lateral deflection of said wing portions when said work surfaces are farthest apart.

27. An adjustable socket according to claim 20 wherein said contact surface is flared and configured to prevent contact of the cam surfaces and the threads on said collar.

28. An adjustable socket according to claim 20 wherein said engagement structure is defined by an axial shaft port formed in a second side of said head portion opposite said wing portions.

29. An adjustable socket according to claim 20 wherein each of said slide elements has a longitudinal spring cavity formed therein, said spring cavities facing one another to form a spring chamber when said jaw members are mounted in said channel, said biasing means including a spring member positioned in said spring chamber whereby movement of said work faces toward one another operates to compress said spring member.

30. An adjustable socket operative to rotatably drive a nut structure and adapted to be selectively adjustable to accommodate different sizes of nut structures, comprising:

a socket body including a head portion and first and second wing portions longitudinally projecting from a first side of said head portion on opposite sides of a longitudinal axis through said socket body, said first and second wing portions separated from one another by a channel region extending diametrically through said socket body and respectively provided with first and second interior surfaces facing each other in opposed relation to define a slideway region therebetween;

first and second jaw members slideably mounted in said channel region for transverse reciprocal movement in said socket body, each jaw member including a slide element slideably received in said channel region and a jaw element rigidly supported by a respective slide element and projecting longitudinally of said socket body, each jaw element configured to extend between and be slideably supported by opposite longitudinal first jaw element sidewall portions which respectively abut said interior surfaces, each jaw element having a longitudinal outer surface facing laterally outwardly of said channel region and a longitudinal inner surface defining a work face adapted to engage said nut structure, said work faces oriented in opposed facing relation to one another and away from one another as said first and second jaw members are reciprocally moved in said socket body, each of said slide elements including a longitudinal spring cavity formed therein, said spring cavities in the form of half cylinders and facing one another to form a cylindrically shaped spring chamber when said jaw members are mounted in said channel;

a helical spring positioned in said spring chamber whereby movement of said work faces toward one another operates to compress said spring member and bias said jaw members apart from one another to expand the space between said work surfaces; and constraining means mechanically acting on each jaw element in opposition to said helical spring for preventing expansion of the space between said work surfaces, said constraining means being selectively operable to selectively vary the maximum degree of expansion between the work surfaces.

31. An adjustable socket adapted to be rotatably driven by a drive member to correspondingly drive a nut structure, the adjustable socket being adjustable to accommodate different sizes of nut structures, comprising:

a socket body having a longitudinal axis and including a head portion and first and second wing portions formed integrally therewith and projecting longitudinally from a first side of the head portion on either side of said longitudinal axis to terminate in free wing ends, said head portion being an engagement structure on a second side opposite said wing portions and operative to engage a drive member, said wing portions having exterior arcuate services oriented in a common cylindrical surface and provided with threads, said first and second wing portions separated from one another by a channel region extending diametrically through said socket body such that said first and second wing portions respectively have first and second flat interior surfaces in opposed relation to one another, said channel region defining a key way region adjacent the head portion and slideway region between the opposed flat interior surfaces;

first and second jaw members freely mounted in said channel region for transverse reciprocal sliding movement therein, each said jaw member including an elongate slide element positioned transversely of said socket body and located in said key way and a jaw element rigidly attached to said slide element and positioned longitudinally of said socket body, each jaw element configured to have a width extending between said first and second flat interior surfaces, said jaw elements each having an outer cam surface formed as a portion of a geometric cone and each jaw element having an inner work face adapted to engage said nut structure, said jaw elements mounted in said slideway between said work surfaces in opposed facing relation and being reciprocally slideable in a transverse direction whereby said work surfaces move toward and away from one another to accommodate differently sized nut structures, each of said slide elements including a longitudinal spring cavity formed therein said spring cavities shaped as half cylinders and facing one another to form a cylindrical spring chamber when said jaw members are mounted in said channel;

a helical spring positioned in said spring chamber whereby movement by said work faces toward one another operates to compress said spring member and bias said jaw members apart from one another; and an annular collar member inwardly threaded and threadably received on said first and second wing portions and having an inner contact surface bearing against said cam surfaces to define a selectively adjustable maximum distance of separation between said work surfaces and whereby threaded advancement of said collar in a first longitudinal direction acts on said cam surfaces to force said working surfaces together against the force of compression of said helical spring and whereby advancement of said collar in an opposite second longitudinal direction allows said helical spring to expand the space between said working surfaces.

* * * * *